US010154930B2

(12) United States Patent
Heneveld, Jr. et al.

(10) Patent No.: US 10,154,930 B2
(45) Date of Patent: Dec. 18, 2018

(54) EMS BACKBOARD

(71) Applicant: Stryker Corporation, Kalamazoo, MI (US)

(72) Inventors: William Ross Heneveld, Jr., Kalamazoo, MI (US); Brandon David Naber, Portage, MI (US); Christopher Gentile, Sturgis, MI (US); Robert Christopher Rusin, Richland, MI (US)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 15/664,835

(22) Filed: Jul. 31, 2017

(65) Prior Publication Data

US 2018/0028376 A1 Feb. 1, 2018

Related U.S. Application Data

(60) Provisional application No. 62/369,419, filed on Aug. 1, 2016.

(51) Int. Cl.

| | |
|---|---|
| ***A61G 7/10*** | (2006.01) |
| ***A61G 1/003*** | (2006.01) |
| ***A61G 1/044*** | (2006.01) |
| ***A61G 1/048*** | (2006.01) |
| ***A61G 1/013*** | (2006.01) |
| ***A61G 1/04*** | (2006.01) |

(52) U.S. Cl.

CPC ..... *A61G 1/003* (2013.01); *A61G 1/013* (2013.01); *A61G 1/042* (2016.11); *A61G 1/044* (2013.01); *A61G 1/048* (2013.01); *A61G 7/1011* (2013.01)

(58) Field of Classification Search

CPC ..... A61G 7/10
USPC ..... 5/81.1 T, 81.1 R, 625–628
See application file for complete search history.

(56) References Cited

U.S. PATENT DOCUMENTS

| | | | | |
|---|---|---|---|---|
| 3,745,998 | A * | 7/1973 | Rose | A61F 5/055 128/DIG. 15 |
| 4,691,962 | A | 9/1987 | Holdt | |
| 4,962,941 | A | 10/1990 | Rembos | |
| 5,479,666 | A | 1/1996 | Foster et al. | |
| 5,699,568 | A * | 12/1997 | Couldridge | A61G 1/01 5/110 |
| 5,704,081 | A * | 1/1998 | Bollinger | A61G 7/1026 5/81.1 T |
| 5,765,243 | A * | 6/1998 | Duncan | A61B 6/0421 128/870 |

(Continued)

FOREIGN PATENT DOCUMENTS

| | | | |
|---|---|---|---|
| CA | 2481694 | A1 | 10/2003 |
| CN | 2548611 | Y | 5/2003 |

(Continued)

*Primary Examiner* — Fredrick C Conley
(74) *Attorney, Agent, or Firm* — Warner Norcross + Judd LLP

(57) ABSTRACT

A backboard includes a body that has length that is sufficient for extending under a person. The body further has an upper side for supporting a person thereon and a lower side for resting on a generally flat surface, with the body forming multiple pivot points between the upper side and the lower side. The body supports a movable contact surface to provide lateral support to and increase the contact area between the backboard and the person supported thereon.

19 Claims, 4 Drawing Sheets

(56) References Cited

U.S. PATENT DOCUMENTS

| | | | | |
|---|---|---|---|---|
| 5,842,237 | A | 12/1998 | Hargest et al. | |
| 6,155,260 | A | 12/2000 | Lavin et al. | |
| 6,792,633 | B1 | 9/2004 | Ito | |
| 6,899,103 | B1 | 5/2005 | Hood et al. | |
| 6,920,656 | B2 | 7/2005 | Roussy | |
| 7,406,729 | B2 | 8/2008 | Hornbach et al. | |
| 7,520,347 | B2 | 4/2009 | Chambliss et al. | |
| 7,636,966 | B2 | 12/2009 | Gallant et al. | |
| 7,637,550 | B2 | 12/2009 | Menna | |
| 7,743,441 | B2 | 6/2010 | Poulos et al. | |
| 7,805,782 | B2 | 10/2010 | Hakamiun et al. | |
| 8,381,330 | B2 | 2/2013 | Roussy | |
| 8,640,283 | B2 | 2/2014 | Broadley et al. | |
| 8,777,879 | B2 | 7/2014 | Johnson | |
| 9,233,033 | B2 | 1/2016 | Valentino | |
| 9,579,240 | B2 | 2/2017 | Krolick et al. | |
| 2003/0159216 | A1* | 8/2003 | Tomcany | A61F 5/3707 5/628 |
| 2009/0119834 | A1* | 5/2009 | Kneale | A61G 1/04 5/81.1 HS |
| 2010/0064439 | A1 | 3/2010 | Soltani | |
| 2010/0170041 | A1 | 7/2010 | Heimbrock et al. | |
| 2012/0096644 | A1 | 4/2012 | Heimbrock | |
| 2012/0124746 | A1 | 5/2012 | Andrienko | |
| 2012/0292883 | A1 | 11/2012 | Noonan et al. | |
| 2014/0299391 | A1 | 10/2014 | Carletti | |
| 2015/0313780 | A1 | 11/2015 | Valentino et al. | |
| 2015/0320625 | A1 | 11/2015 | White | |
| 2016/0287454 | A1 | 10/2016 | Magill et al. | |
| 2016/0374884 | A1 | 12/2016 | Blickensderfer et al. | |
| 2017/0042749 | A1 | 2/2017 | Valentino et al. | |
| 2017/0165135 | A1 | 6/2017 | Krolick et al. | |
| 2017/0165136 | A1 | 6/2017 | Krolick et al. | |
| 2017/0196740 | A1 | 7/2017 | Krolick et al. | |

FOREIGN PATENT DOCUMENTS

| | | | |
|---|---|---|---|
| CN | 201005885 | Y | 1/2008 |
| EP | 1226803 | A1 | 7/2002 |
| GB | 1046444 | | 4/1962 |
| WO | 9729726 | | 8/1997 |
| WO | 0239944 | A2 | 5/2002 |
| WO | 2008127089 | A1 | 10/2008 |
| WO | 2009114806 | A2 | 9/2009 |
| WO | 2011072023 | A2 | 6/2011 |

* cited by examiner

EMS BACKBOARD

CROSS-REFERENCE TO RELATED APPLICATIONS

This application claims the benefit of U.S. provisional patent application Ser. No. 62/369,419 filed Aug. 1, 2016, by inventors William Ross Heneveld Jr., Brandon David Naber, Christopher Gentile and Robert Christopher Rusin, the complete disclosure of which is incorporated by reference in its entirety herein.

TECHNICAL FIELD AND BACKGROUND

A common lifting situation in the EMS industry is picking a person up from the floor or ground using a backboard. Typically, a person is first "log rolled" onto the backboard, and then the backboard is lifted and moved onto a patient handling apparatus, such as an emergency cot. Log rolling refers to when a person is rolled upwardly, after which a backboard is positioned alongside the person and then tilted up about the edge closest to the person so that the person can then be leaned against the backboard. Thereafter, the person and backboard can be lowered together onto the floor or ground surface by tilting the backboard about the edge that is located under the person. Once the person is lowered to the floor, EMS personnel typically lift the person and the backboard and place it onto a cot. Because the backboard is typically lying flat on the floor or ground surface, it is particularly hard for EMS personnel to get into a proper lifting position, which can result in stress and strain on EMS personnel.

Further, conventional backboards can be uncomfortable, and when loaded onto a cot can make a person feel unstable. This is especially true while being transported, which can cause a person to tense up and potentially strain muscles that are already injured.

Accordingly, there is a need to reduce the stress and strain on EMS personnel when handling a person who needs to be moved from a lying position on a floor or ground surface to a cot and to make the backboard more comfortable, but without compromising its function—to keep a person in a supine position.

SUMMARY

Accordingly, a backboard is disclosed that reduces the effort needed to log roll a patient onto backboard.

In one embodiment, a backboard includes a body with a length sufficient for extending at least partially or under the full length of a person in a supine position. The body further has an upper side for supporting a person thereon and a lower side for resting on a generally flat surface. In addition, the body supports a movable contact surface to increase the contact area between a person supported thereon and the backboard.

In one aspect, the body includes a pair of the movable surfaces, with each movable surface being adjacent a respective longitudinal edge of the backboard.

In another aspect, the movable surface is formed by a plate that is mounted to the body. For example, the plate may be hinged to the body and is movable between a deployed position, wherein the plate increases the contact area between a person supported on the body and the backboard, and a retracted position.

In yet another aspect, the plate is flush with the upper side of the body when the plate is moved to the retracted position.

According to yet other aspects, the body includes a support to hold the plate in the deployed position. For example, the support may be an actuator, which moves the plate to its deployed position.

According to other aspects, the body is a hollow body. For example, the body may be formed from a thermoplastic material.

In another embodiment, a backboard includes a body with a central longitudinal axis and a length extending along the central longitudinal axis sufficient for extending under at least a portion or the full length of a person in a supine position. The body further has an upper side for supporting a person thereon and a lower side for resting on a generally flat surface. The body is configured to form a first fulcrum below its upper side for pivoting the body about a first pivot axis parallel to the central longitudinal axis over a first range of motion. The lower side includes a second fulcrum for pivoting the body about a second pivot axis parallel and closer to the central longitudinal axis than the first pivot axis.

In one aspect, the backboard also includes a retaining device to help retain a person on the backboard when the body is pivoted about one of the pivot axes.

In a further aspect, the retaining device comprises a movable surface, which is deployable to provide lateral support to the person supported thereon and to increase the contact area between a person supported thereon and the backboard.

In yet another aspect, the body is hollow, which forms a space beneath the upper side to form a compartment.

According to another aspect, the body has a height in a range of 2-5 inches, and optionally about in a range of 3-4 inches.

In yet another embodiment, a backboard includes a body with a length sufficient for extending under at least portion or the full length of a person in a supine position. The body further has an upper side for supporting a person thereon, a lower side for resting on a generally flat surface, a first fulcrum for pivoting the body about a first pivot axis, and a second fulcrum for pivoting the body about a second pivot axis spaced from the first pivot axis. The upper side has a trough-shaped surface to provide lateral support to a person lying on the backboard to increase the contact area between the backboard and the person supported thereon.

In one aspect, the upper side is reconfigurable between a first configuration and a second configuration, with the second configuration forming the trough-shaped surface. Optionally, the first configuration is a planar configuration.

In one aspect, the body is hollow and includes an accessible compartment.

In a further aspect, the body is formed from a thermoplastic.

According to yet another aspect, the body includes a pair of movable surfaces, which forms the trough-shaped surface.

Accordingly, the backboard disclosed herein can help reduce the stress and strain on EMS personnel when handling a person who needs to be moved from a supine position on a floor or ground surface to a patient handling apparatus, such as an emergency cot, and further may improve the comfort for a person supported thereon.

DETAILED DESCRIPTION

Figures 1, 2:
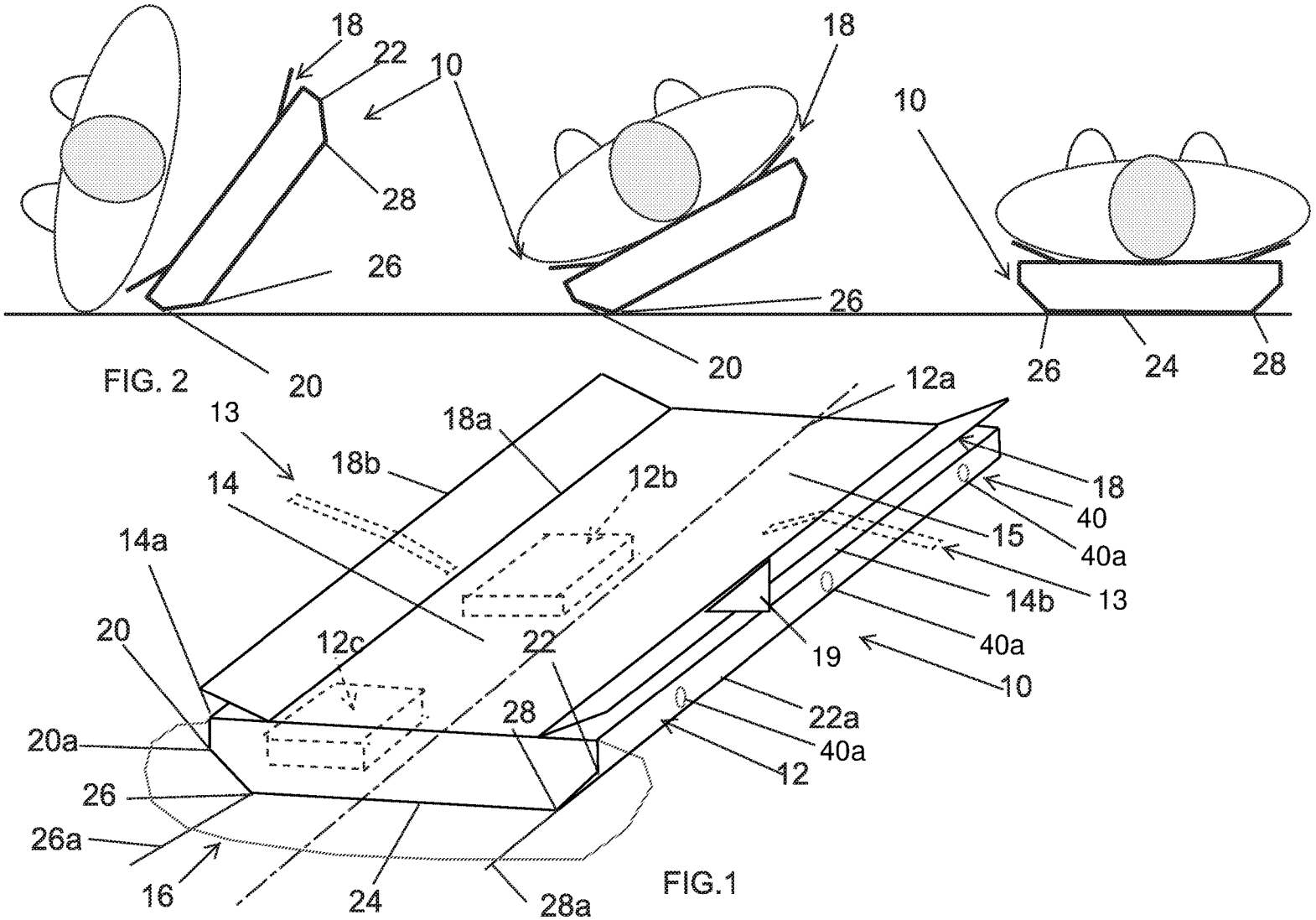
FIG. 1 is a perspective view of an EMS backboard.
FIG. 2 is an end elevation view illustrating the rotation sequence of the backboard of FIG. 1.

Referring to FIG. 1, the numeral 10 generally designates an EMS backboard, which can be used to transport a person in a supine position. As will be more fully described below, backboard 10 is configured to make it easier for EMS personnel to log roll a person, who is in a supine position on a planar surface, such as a floor or ground, and further to make it more comfortable for a person supported on backboard 10. In the illustrated embodiment, backboard 10 has a cross-section (orthogonal to its central longitudinal axis) that includes multiple fulcrums to form multiple pivot axes to facilitate use of the backboard and handling of a patient supported thereon.

As best seen in FIG. 1, backboard 10 includes a body 12 with an upper side 14, for supporting a person thereon, and a lower side 16 for resting on a generally planar surface, such as a floor or ground. Upper side 14 is generally wider than lower side 16 and may have a multisided cross-section, such as a trapezoidal shaped cross-section (4 sided) or an irregular hexagon to thereby form multiple fulcrums, as described below. Further, upper side 14 has a trough-shaped surface 15, which helps retain a person on backboard 10 by providing lateral support to a person lying on backboard 10. Further, the trough-shaped surface 15 increases the contact area between the person and the backboard. As will be more fully described below, in the illustrated embodiment, upper side 14 may be reconfigurable between two configurations—with one configuration being trough-shaped surface 15 and another configuration where the movable structure forming the trough shaped surface is no longer deployed. For example, the second configuration may provide a planar surface to facilitate storage (e.g. stacking of backboard 10 on another similar backboard) and/or to facilitate transfer of a person supported on backboard 10 off backboard 10, for example, onto a stretcher.

Further, although illustrated as a rectangular upper side, the shape of the upper side may vary. For example upper side 14 may be curved or have curved portions or may have an irregular geometric shape with multiple sides. Further, upper side 14 may be formed from separate discrete sections. As such, the outer edges of the upper side may be non-linear and, further, may be discontinuous.

In one embodiment, backboard 10 includes movable surfaces that form the trough-shaped surface 15. In the illustrated embodiment, the movable surfaces are formed by panels or plates 18, described below. Although illustrated as planar, it should be understood that plates 18 may be non-planar and, for example, may be curved or contoured and have curved or contoured portions, for example to generally follow the shape of a person's body. As would be understood from the above, trough-shaped surface 15 can provide increased comfort to a person supported on backboard 10 by in effect cradling the person supported on backboard 10, which is especially comforting during transport in a vehicle.

Again referring to FIG. 1, body 12 has a central longitudinal axis 12*a* and a length along the central longitudinal axis 12*a* sufficient for extending under at least a portion of a patient's body and, optionally, under the full length of a person lying in a supine position. In the illustrated embodiment, trough-shaped surface 15 extends along the full length of body 12 and is formed by a pair of opposed panels or plates 18. Plates 18 may be movably mounted to upper side 14 of body 12 so that each plate 18 may be moved between a deployed position (such as shown in FIGS. 1-5) and a retracted, flat position. In one embodiment, plates 18 are pivotally mounted along their proximal edge 18*a* to upper side 14 of body 12 to thereby form flaps. Optionally, when plates 18 are moved to their retracted positions, e.g. flat positions, the outer distal edges 18*b* of plates 18 may extend beyond outer sides or edges 14*a*, 14*b* of upper side 14 or may align with or be immediately adjacent outer edges 14*a*, 14*b*. Alternately, distal edges 18*b* of plates 18 may be inward of outer edges 14*a*, 14*b*. Thus, the outer edges 14*a*, 14*b* of body 12 may also be used as fulcrums to pivot the backboard 10, as more fully described below.

As noted above, plates 18 may be movable between retracted positions and deployed positions. For example, each plate 18 may include one or more supports 19 (see FIGS. 1 and 5), which are configured to support each plate 18 in its deployed position, but then release each respective plate when support is removed. For example, the supports may include manually operable mechanical supports or actuators, such as pneumatic, hydraulic or electric actuators. Suitable actuators may include hydraulic cylinders, including double acting cylinders, to move the plates 18 to and from their deployed positions. Other actuators may include electrically powered actuators, including linear motors, electromagnets, shape memory wires, or the like.

In one embodiment, the supports are pneumatic and may include one or more bladders positioned beneath the respective plates 18, which when inflated raise the plates to their deployed position. Once deflated, the plates are allowed to return to their retracted position, for example, under the force of gravity. Alternately, the plates may be coupled to the bladders, so that when the bladders are deflated or evacuated of air, the bladders will assist in returning the plates to their retracted positions. In another example, the supports may include one or more kickstand type structures, which are mounted underneath a respective plate and manually moved between its deployed support position and its retracted position beneath the respective plates.

As best understood from FIG. 2-5, plates 18 are mounted to body 12 inwardly from outer edges 14*a*, 14*b*. For example, plates 18 may be mounted inwardly from outer edges 14*a*, 14*b* in a range of 2 to 7 inches, optionally in a range of 3 to 5 inches, and further have a lateral width in a range of 2 to 7 inches, optionally in a range of 3 to 5 inches. It should be understood the size and lengths of plates 18 may vary. In the illustrated embodiment, plates 18 extend the full length of body 12. However, the plates 18 may extend over only a portion of the length of body 12. Further, multiple plates 18 may be provided along each side of body 12, and independently movable between their deployed and retracted position.

In addition, as noted above, the support or supports under plates 18 may provide sufficient support to plates 18 so that their outer distal edges 18*b* may be used as fulcrums for pivoting backboard 10 over at least an initial range of motion. Having a sharper pivot point (provided by the edges of plates 18) reduces the chances of the backboard 10 sliding when rolling the patient.

Figure 3:
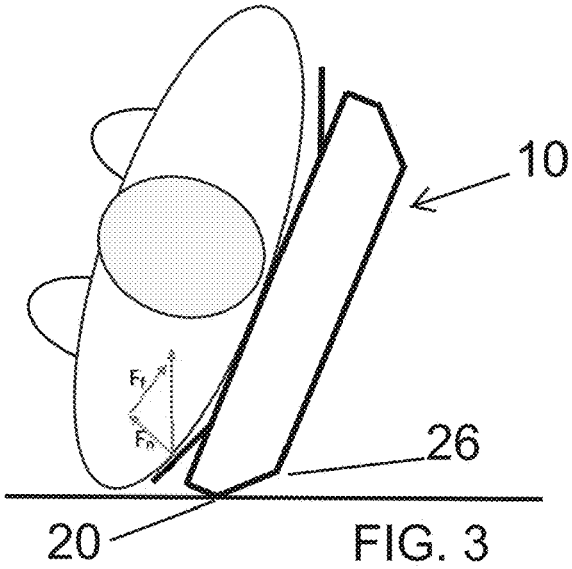
FIG. 3 is an enlarged end elevation view illustrating the rotation of the backboard FIG. 1 about one range of motion.
Figure 4:
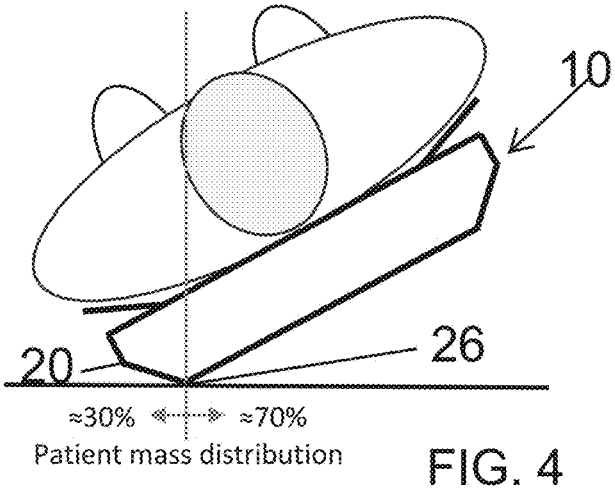
FIG. 4 is an enlarged end elevation view illustrating the rotation of the backboard about another range of motion.
Figure 5:
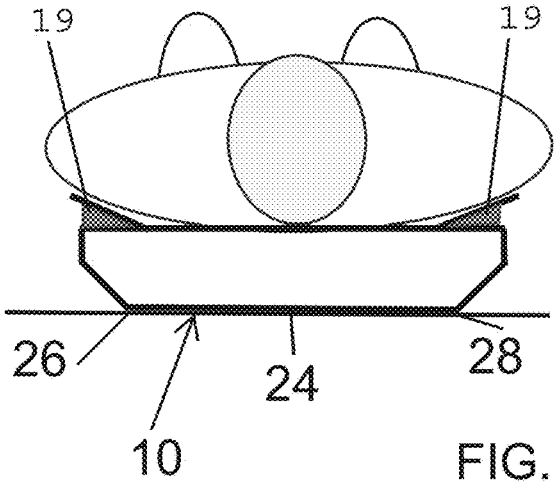
FIG. 5 is an enlarged end elevation view illustrating the backboard of FIG. 4 lowered to a planar surface.

In this manner, referring to FIGS. 3-5, when plates 18 are moved to their deployed positions, plates 18 apply a retaining force on the person supported on backboard 10. As noted, the resulting trough-shaped surface formed by plates 18 also increases the comfort for the person, especially when the person and backboard 10 are mounted on a cot and are being transported.

Optionally, body 12 has a geometry that can reduce the effort needed by an attendant to log roll a patient using backboard 10. As will be described below, the body is configured with multiple fulcrums to provide multiple pivot axes to facilitate the pivoting of backboard 10. The fulcrums can be formed by edges, surfaces, or points.

As best seen in FIGS. 1-5, lower side 16 of body 12 is the lower facing side bounded between opposed outer edges 14*a*, 14*b* of upper side 14 and has a lowermost surface 24 bounded by opposed second longitudinal edges 26, 28. In the illustrated embodiment, additional longitudinal edges 20, 22 may be provided beneath outer edges 14*a*, 14*b*, respectively, which are spaced outwardly of longitudinal edges 26, 28 and can be used as fulcrums for pivoting the body about pivot axes 20*a*, 22*a* (FIG. 1) parallel to the central longitudinal axis 12*a* over one range of motion. Each of longitudinal edges 26 or 28 can also be used as fulcrums for pivoting the body 12 about pivot axes 26*a*, 28*a* (FIG. 1) over another range of motion. Pivot axes 26*a*, 28*a* are parallel to the central longitudinal axis 12*a* but spaced inwardly from pivot axes 20*a*, 22*a*, respectively, and closer to the central longitudinal axis of the backboard 10 so that less effort is needed by an attendant to guide a person's rotation. Further, as noted above, plates 18 may be used to initially pivot backboard 10. In addition, as noted, either outer edge 14*a* or 14*b* may be used as a fulcrum when plates 18 do not extend beyond the respective outer edges 14*a* or 14*b*.

Figure 8:
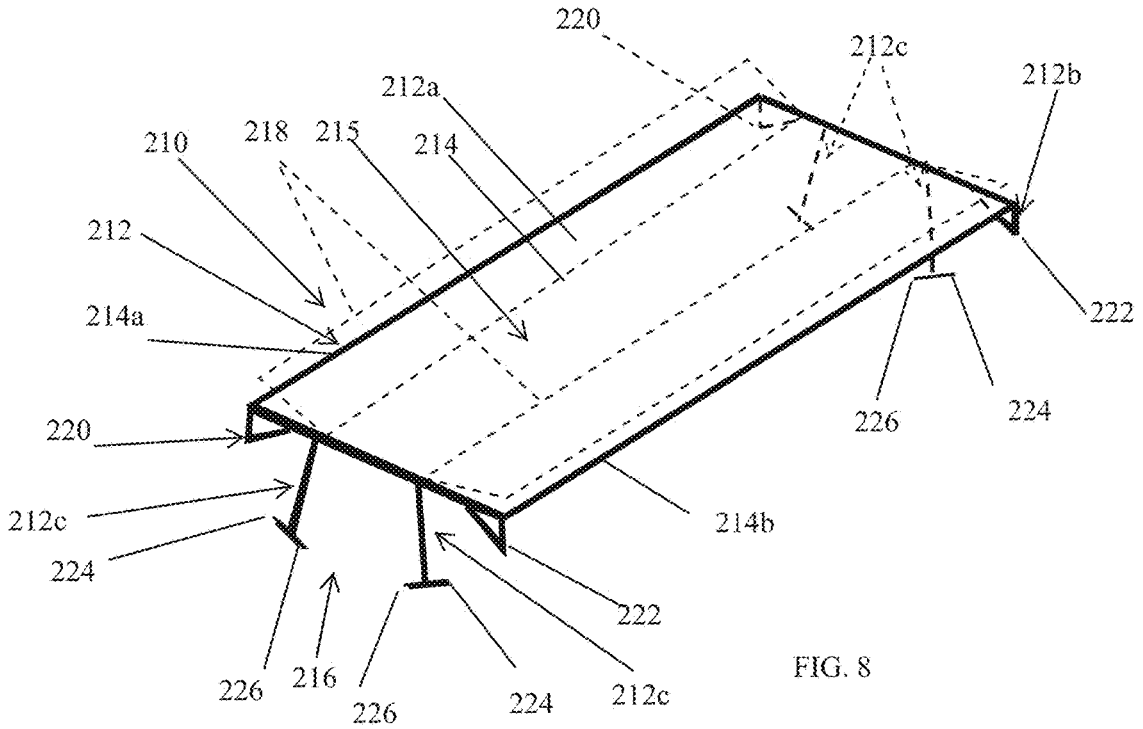
FIG. 8 is a perspective view of another embodiment of an EMS backboard.
Figure 9:
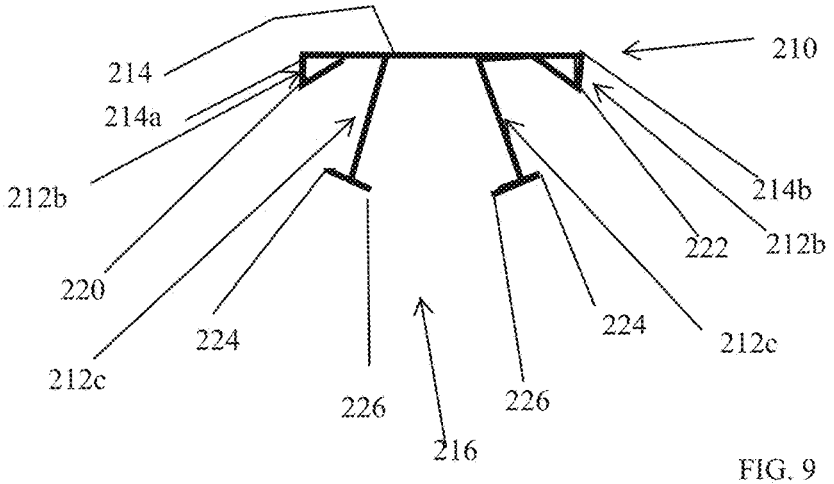
FIG. 9 is an end elevation view of the backboard of FIG. 8.

Although illustrated as having three longitudinal edges on either lateral side of body 12, body 12 may include fewer longitudinal edges or additional longitudinal edges, and further may have curved portions or have virtual edges, as described in reference to FIGS. 8 and 9. Optionally, lower side 16 may be a single curved side extending from edge 14*a* to 14*b* or may include multiple curved sections to thereby again provide multiple fulcrums and multiple pivot axes. In addition, as more fully described in reference to FIGS. 8 and 9, the fulcrum or fulcrums may be provided by two points instead of edge(s) or surface(s)—which form the virtual edges.

In the illustrated embodiment, each plate 18 is hinged to the body 12 so that each plate is movable about it proximal edge 18*a* between its deployed position, wherein the plate increases the contact area between a person supported on the body, and its retracted position. In one embodiment, each plate 18 maybe integrally formed with body 12, with its hinge formed by a living hinge. Alternately, each plate 18 may be rigidly mounted to body 12. Further, plate 18 may be segmented into two or more independent segments, with one or more segments independently hinged and independently moveable or rigidly mounted to body 12.

In a further embodiment, each plate 18 may be mounted in a recess formed in upper side 14 of body 12 so that the plates 18 may be returned to a stowed position, and optionally flush with the upper side 14, when the plates 18 are moved to their retracted positions.

In another embodiment, body 12 is a hollow body with walls that form the respective sides of the backboard. For example, body 12, as well as plates 18, may be formed from a polymeric material, including a thermoplastic. Plates 18 may instead be formed from metal or a composite material or a combination of metal and plastic. For example, plates 18 may be formed from metal frames (e.g. wire or tubular frames) that are molded over with a plastic.

Suitable methods of forming body 12 include molding, such as blow molding. Additionally, as described in reference to FIGS. 8 and 9, the backboard may be formed or assembled from frame members and one or more plates or panels to include one or more open sides. For example, the wall may be virtually nonexistent or made up at least partially by a frame member. Further, because body 12 can be hollow or has a space under the upper side, body 12 may be formed with one or more storage spaces, such as compartments 12*b*, 12*c*. For example, compartments 12*b*, 12*c* may be accessible through the outer surface of body 12. In the illustrated embodiment, compartment 12*b* is accessible through the upper side 14 of body 12, while compartment 12*c* is accessible through the end wall of body 12. It should be understood that the number, the location, and the size of the compartments may be varied. Further as noted, one or more sides of the backboard may be open to allow access to storage space under upper side 14.

Each compartment 12*b*, 12*c* may include a cover or an access door to close the compartment. For example, the access door may be slidably mounted or pivotally mounted to body 12 by a hinge. Other designs of access doors are possible. In this manner, the compartments may be opened when items inside the compartment are to be retrieved or used and then closed. Alternately, the compartments may have an open side so that they are quickly accessible. In other embodiments, one or more compartments may be movably mounted in body 12 so that the compartment may be slidable, extendible, or otherwise deployable, e.g. like a drawer, from body 12. Further, the compartment may be removable for replacement. In other embodiments, the storage space may be configured to receive an accessory for storage in backboard 10.

In this manner, the cavity of body 12 can be used to store or house one or more components or accessories. For example, body 12 may be used to house a medical device or equipment, for example, for treating or testing a person, such as a CPR device, or an inflatable mattress or cover that can be used on backboard 10 to increase comfort for the person supported on backboard 10. These devices or equipment may be the type of devices or equipment normally carried by EMS personnel and, hence, separate structures from the structure of the backboard itself before being stowed away.

In one embodiment, the medical device comprises a thermal management device, which can be stored in one of the compartments, which can then be retrieved for use with the person supported on backboard 10. In yet another embodiment, the thermal management device may be incorporated or integrated into the body 12 so that body 12 warms or cools the person supported thereon. As noted below, other devices may be stored in the body of backboard 10, including bearings to facilitate transporting the backboard across the ground or floor. Further, any of these devices or accessories may either essentially form part of the backboard or become part of the backboard when stowed in the backboard and, therefore, may provide a fulcrum point.

In one embodiment, body 12 has a height (as measured from its lowermost surface to its upper side) in a range of 2-5 inches and, optionally, about 3-4 inches. As noted above, body 12 may be formed as a hollow body, and formed, for example, by blow molding. Body 12 may be filled with a fluid, such as a gas or liquid, which can provide buoyancy to backboard 10 so that it can be used as a flotation device. In another embodiment, body 12 is formed as a monolithic or solid body, such as from foam, with cavities optionally formed in the monolithic body to form the one or more compartments noted above.

Further, the upper side 14 (and/or plates 18) of body 12 may be covered or coated with a cushioning layer, such as foam or gel or, as noted, by an inflatable mattress. The cushioning layer may be permanent, such as in the case when it is formed by coating or when applied using an adhesive, or the cushioning layer may be removable, and optionally held in place by releasable fasteners, such as snaps or Velcro strips are patches.

In addition, body 12 may include handles or hand holds 40 (FIG. 1) formed therein or mounted thereto to ease handling and/or lifting of body 12. For example, recesses 40*a* may be formed at discrete locations around the sides of body 12 to form hand holds. Alternately, or in addition, straps may be mounted to body 12 to form hand holds. Further, body 12 may incorporate straps 13 (FIG. 1) to restrain a person supported on body 12. For example, body 12 may be formed with through openings to allow the straps to be threaded through the openings and thereby mounted to the body 12, or the straps may be fastened to body 12 using fasteners, including rivets or the like, or an adhesive.

Figure 6:
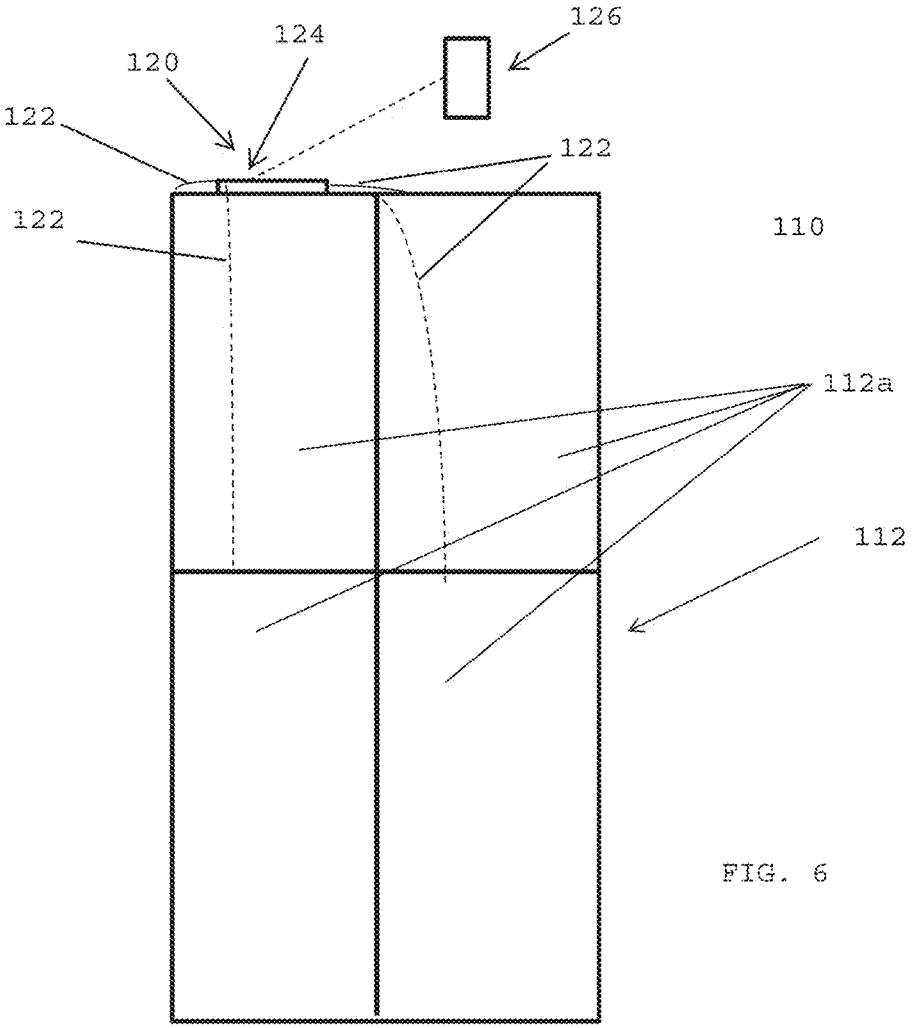
FIG. 6. is a plan view of another embodiment of an EMS backboard.

Referring to FIG. 6, the numeral 110 designates another embodiment of an EMS backboard. In the illustrated embodiment, similar to the previous embodiments, backboard 110 includes a body 112. At least a portion of body 112 may be formed from one or more bladders 112*a*. In this manner, at least a portion of body 112 may be inflated and transformed between a rigid state (when fully inflated) and a non-rigid inflated state wherein the body 112 (or portion of body 112) is bendable or pliable to wrap around at least a portion of a person's body. For example, body 112 may be formed from multiple bladders, with a right set of bladders and a left set of bladders. Further, each set of bladders may include foot end and head end bladders.

Once one or more bladders are in their non-rigid inflated state, the bladder or bladders may be wrapped around a portion of the person's body (or the person's whole body). Then, the pressure in the bladder or bladders may be increased to form a vacuum splint. For example, bladders 112*a* may be separately and independently inflatable.

Figure 7:
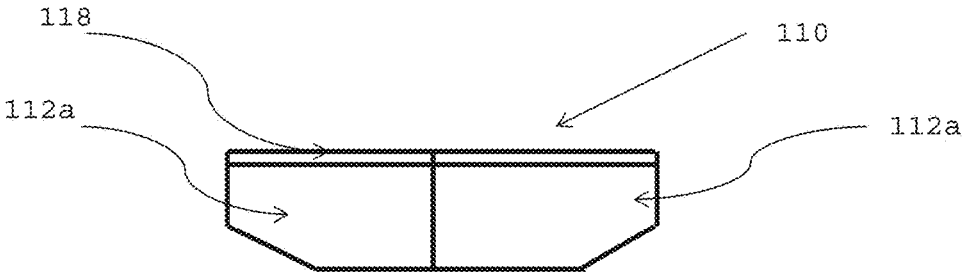
FIG. 7 is an end elevation view of the backboard of FIG. 6 with an additional bladder layer on its top side.

In one embodiment shown in FIG. 7, the top side of body 112 may include one or more bladders 118, which may be inflated to form the trough shaped upper surface described above. Again the bladders may be independently and separately inflated to a rigid state to form a cradle for a person supported thereon. An additional bladder layer may be then provided on top of bladders 118 to form a vacuum splint around a portion of the person's body, such as a leg, or the person's full body.

The bladder or bladders may be inflated by a pneumatic system 120 (FIG. 6), which includes one or more conduits 122, a flow control unit 124, with one or more fans or pumps, one or more electrically controlled valves, such as solenoid valves, and a microprocessor based controller, which powers the fan or blower and valves (to control the flow of air to the bladders from the fan or pump) to control inflation of the bladder or respective bladders. In the case of multiple bladders, a valve manifold may be provided to control the flow of air from the fan or pump to each of the bladders so that the bladders may be individually and separately controlled. The microprocessor based controller may receive input signals from and be controlled by a user interface 126, such as a keypad or touchscreen, which may be a local interface (e.g. hardwired to the flow control unit 124) or a remote user interface, for example, a wireless hand-held user interface or a wireless user interface mounted in an emergency vehicle.

Referring to FIGS. 8 and 9, the numeral 210 generally designates another embodiment of an EMS backboard. Backboard 210 is also configured to make it easier for EMS personnel to log roll a person onto the backboard, who is in a supine position on a planar surface, such as a floor or ground, and further to make it more comfortable for a person supported on backboard 210. Similar to the previous embodiments, backboard 210 has a cross-section (orthogonal to its central longitudinal axis) that includes multiple fulcrums to form multiple pivot axes to facilitate use of the backboard and handling of a patient supported thereon. As will be more fully described below, one or more of the fulcrums may be formed by virtual edges.

As best seen in FIG. 8, similar to the previous embodiment, backboard 210 includes an upper side 214, for supporting a person thereon, and a lower side 216, which is configured to rest on a generally planar surface, such as a floor or ground. Also similar to backboard 210, upper side 214 may include a trough-shaped surface 215, which helps retain a person on backboard 210 by providing lateral support to a person lying on backboard 210. Trough-shaped surface 215 may also be formed by movable surfaces, such as a pair of plates 218. For further details of plates 218 and how they may be constructed, supported, and/or mounted, reference is made to the previous embodiment.

As noted above, in the illustrated embodiment, backboard 210 may have one or more open sides. For example, in the illustrated embodiment, the body of backboard 210 is constructed from a frame 212 with a panel 212*a* provided or formed thereon, which forms upper side 214. For example, panel 212*a* may be molded onto or attached to the frame. Panel 212*a* forms the upper outer edges 214*a*, 214*b* of upper side 214, which may form pivot axes to be used as fulcrums to pivot the backboard 210, as described above. Similarly, the outer edges of plates 218 may be used as fulcrums. Further, although illustrated as a rectangular upper side, similar to the first embodiment, the shape of the upper side may vary. For example, the panel 212*a* forming upper side 214 may be curved or have curved portions or may have an irregular geometric shape with multiple sides. Further, panel 212*a* may be formed from separate discrete sections. As such, the outer edges of the upper side may be non-linear and, further, may be discontinuous.

As best seen in FIGS. 8-9, lower side 216 of backboard 210 includes a first pair of downwardly depending frame members 212*b*, which extend downwardly from edges 214*a*, 214*b*, and a second pair of downwardly depending frame members 212*c* that extend downwardly from frame 212 inwardly of edges 214*a*, 214*b* to thereby form supports at the head end and foot end of backboard 210. The size, shape, number, and location of these supports may be varied, and, for example, need not be located at the ends and instead located inwardly from the ends, as noted below. Further, a single support may be provided.

The lower ends or corners 220, 222 of frame members 212*b* form pivot points or surfaces, which can also be used as fulcrums for pivoting the backboard 210 about pivot axes parallel to the central longitudinal axis of backboard 210 over one range of motion. In this manner, the pivot points form a virtual edge there between for pivoting frame 212.

In the illustrated embodiment, downwardly depending frame members 212*c* may be T-shaped. In this manner, the lower corners 224, 226 of frame members 212*c* can also be used as fulcrums for pivoting backboard 210 about respective pivot axes (over another range of motion), which are parallel to the central longitudinal axis of backboard 210 and are spaced inwardly from the pivot axes formed by downwardly depending frame members 212*b*. The pivot axes formed by downwardly depending frame members 212*c* are closer to the central longitudinal axis of the backboard 210 so that less effort is needed by an attendant to guide a person's rotation. Further, as noted above, plates 218 may also be used to pivot (at least initially) backboard 210.

Although illustrated as having three pivot axes on either lateral side of backboard 210, backboard 210 may include fewer pivot axes or additional pivot axes, and further may have curved portions. Optionally, lower side 216 maybe formed from a single curve frame member or may include multiple curved sections to thereby again provide multiple fulcrums. Additionally, intermediate downwardly depending frame members may be provided along the length of backboard 210, between the head end and the foot end. Further, although shown as being located at the head end and the foot end of backboard 210, downwardly depending frame members 212*c* may be located inwardly from the foot end and the head end (e.g. located at a ¼ of the length and ¾ of the length of the backboard), and further may be closer to the middle of the backboard provided they provide sufficient stability. As noted above, additional intermediate or fewer depending frame members 212*c* may be provided. Additionally, although shown as being orientated in a plane that is perpendicular to the central longitudinal axis of the backboard, the downwardly depending frame members may be arranged in an angled plane so that they are diagonal to the central longitudinal axis. Further, their shape may be varied.

As noted above, backboard 210 may be constructed of a frame 212 with panel 212*a* forming upper side 214. Panel 212*a* may be formed from a polymeric material, including a thermoplastic, which is over molded or attached to frame 212. Frame 212 may be formed from tubular members, such as metal or composite material tubular members, which can be welded or assembled using fasteners, to form an open framed body. Further, because frame 212 is open and hollow, it forms a space under the upper side 214 for storage.

The space may include recesses, rails, or other structures formed or mounted therein to allow accessories to be mounted therein.

In this manner, the cavity of backboard 210 may also be used to store or house one or more components or accessories. Examples of components or accessories that may be mounted therein reference is made to the first embodiment.

In one embodiment, backboard 210 has a height (as measured from its lowermost surface to its upper side) in a range of 2-5 inches and optionally about 3-4 inches. While the upper side of frame 212 is closed by panel 212*a*, it should be understood that additional plates or panels may be mounted to frame 212 to close one or more sides of backboard 210.

Further, similar to the first embodiment, the upper side 214 and/or plates 218 may be covered or coated with a cushioning layer, such as foam or gel or, as noted, by an inflatable layer or mattress. The cushioning layer may be permanent, such as in the case when it is formed by coating or when applied using an adhesive, or the cushioning layer may be removable and, optionally, held in place by releasable fasteners, such as snaps or Velcro strips or patches.

Accordingly, the backboard disclosed herein has a geometry that facilitates handling of the backboard and the person supported thereon. The thicker backboard allows for multiple fulcrums to be formed to provide multiple pivot axes, which can reduce the effort to log roll the patient. The angled surfaces of the trough-shaped surface on the upper side of the backboard reduces the opportunity for the patient to slide off the backboard during transfer. Further, as noted having a sharper pivot point (in the case of the plates being used as the initial fulcrum) reduces the chance for the backboard to slide while rolling the patient.

In addition, the backboard may be used with or incorporated into a lifting apparatus, such as disclosed in U.S. Prov. Pat. application Ser. No. 62/369,417 entitled MULTI-FUNCTION PERSON HANDLING EQUIPMENT and U.S. Prov. Pat. Application Ser. No. 62/369,423 entitled PERSON SUPPORT APPARATUS SYSTEM, both filed by Applicant Stryker Corp. on Aug. 1, 2016, which are incorporated by reference herein in their entireties.

Further, bearing assemblies or a lifting apparatus may be stored in the cavity of the backboard body, so that they or it may be deployed to facilitate handling of the backboard and then returned, either fully or partially, inside the backboard for storage. For example, the lifting apparatus may include support legs with gears or any mechanical, electrical, or hydraulic mechanism to move the legs between a deployed position and a folded or stored position. Suitable bearings may include casters, wheels, tracks, or skis, which can be stowed at least partially in the backboard, and then deployed for use. Given the thickness of the backboard, the bearing assemblies or lifting apparatus may be fully enclosed inside the backboard, as noted, or may be folded or collapsed into one or more recesses formed in the lower side of the backboard. Further, the backboard may have notches or recesses or couplers for receiving and, optionally, engaging a patient transport lifting device. For example, the patient transport lifting device may include arms, e.g. forklift-like arms, which can extend into and are received in the notches or recesses provided or formed in the backboard so that the backboard may be lifted by a powered lifting apparatus.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

We claim:

1. A backboard comprising:

a body having a central longitudinal axis and a fixed cross-section, said body further having an upper side extending across said body for supporting a person at least on a central portion thereof and a lower side for resting on a generally flat surface, said body being configured to form a first fulcrum below said upper side for pivoting said body about a first pivot axis parallel to the central longitudinal axis over a first range or motion; and said lower side including a second fulcrum for pivoting said body about a second pivot axis parallel and closer to said central longitudinal axis than said first pivot axis.

2. The backboard according to claim 1, wherein said upper side is bounded by opposed longitudinal sides and includes two opposed upper edges, and said longitudinal sides having two lower edges, and one of said lower edges forming said first fulcrum for pivoting said body about said first pivot axis.

3. The backboard according to claim 1, further comprising a retaining device configured to help retain a torso of a person on said backboard when said body is pivoted about one of said pivot axes.

4. The backboard according to claim 3, wherein said retaining device comprises a movable surface pivotal about a longitudinal axis parallel and spaced from said central longitudinal axis, said movable surface deployable to increase the contact area between said backboard and a torso of a person supported thereon.

5. The backboard according to claim 1, wherein said body has an irregular hexagon shaped fixed cross-section.

6. The backboard according to claim 1, wherein a plate is hinged to said body, said plate being movable between a retracted position and a deployed position wherein said plate increases the contact area between a torso of a person supported on said body and said backboard.

7. The backboard according to claim 6, wherein said body includes a support to hold said plate in said deployed position.

8. The backboard according to claim 1, wherein said body comprises a hollow or open framed body.

9. The backboard according to claim 1, wherein said body has a height from said lower side to said upper side in a range of 2-5 inches, and optionally a height from said lower side to said upper side in a range of about 3-4 inches.

10. A backboard comprising:

a body having a central longitudinal axis, said body further having an upper side for supporting a person thereon and a lower side for resting on a generally flat surface, said upper side forming a continuous support surface extending across said body along a lateral axis orthogonal to said central longitudinal axis, said body being configured to form a first fulcrum, said first fulcrum below said upper side for pivoting said body about a first pivot axis parallel to the central longitudinal axis over a first range or motion; and said lower side including a second fulcrum for pivoting said body about a second pivot axis parallel and closer to said central longitudinal axis than said first pivot axis, and wherein said body includes a space beneath said upper side for storing accessories or components.

11. The backboard according to claim 10, wherein said space is configured for receiving one or more bearings or a lifting mechanism.

12. The backboard according to claim 10, wherein said space forms a compartment or is configured for receiving a compartment for storing accessories therein.

13. A backboard comprising:

a body having a width and a central longitudinal axis, said body further having an upper side-forming an upper surface for supporting a person on a central portion thereof and a lower side for resting on a generally flat surface, said upper surface extending across said width of said body, said body being configured to form a first fulcrum, and said first fulcrum formed below said upper side for pivoting said body about a first pivot axis parallel to the central longitudinal axis over a first range or motion; and said lower side including a second fulcrum for pivoting said body about a second pivot axis parallel and closer to said central longitudinal axis than said first pivot axis, and said body including at least one bladder forming an inflatable surface in or on said body or at least a portion of said body, said bladder being inflatable between a rigid inflated state and a non-rigid inflated state, and said bladder being bendable or pliable when in said non-rigid inflated state for wrapping around the at least a portion of a person's body.

14. A backboard comprising:

a body having a width and a central longitudinal axis, said body further having an upper side forming an upper surface across said width of said body for supporting a person of a central portion thereof, a lower side for resting on a generally flat surface, and a first fulcrum below said upper side for pivoting said backboard about a first pivot axis;

said body having a second fulcrum below said upper side for pivoting said backboard about a second pivot axis spaced from said first pivot axis, and said second fulcrum being fixed relative to said first fulcrum; and said upper surface having a trough-shape to provide lateral support to at least a torso of a person lying on said backboard.

15. The backboard according to claim 14, wherein said upper side is reconfigurable between a first configuration and a second configuration, with said second configuration forming said trough-shaped surface, and said first configuration comprising a planar configuration.

16. A backboard comprising:

a body having a width and a central longitudinal axis, said body further having an upper side forming an upper surface extending across said width of said body for supporting a person on a central portion thereof, a lower side for resting on a generally flat surface, and a first fulcrum below said upper side for pivoting said backboard about a first pivot axis;

said body having a second fulcrum below said upper side for pivoting said backboard about a second pivot axis spaced from said first pivot axis; and said upper surface having a trough-shape to provide lateral support to at least a torso of a person lying on said backboard, wherein said body comprises a space beneath said upper side, said space forming a compartment.

17. The backboard according to claim 16, wherein said body is formed from a thermoplastic material.

18. The backboard according to claim 16, wherein said body includes a pair of movable surfaces, said pair of movable surfaces forming said trough-shape surface.

19. A backboard comprising:

a body having a central longitudinal axis and a fixed cross-section, said body further having an upper side and a lower side for resting on a generally flat surface, said upper side forming a continuous support surface extending across said body along a lateral axis orthogonal to said central longitudinal axis to support a person thereon, and said body being configured to form a first fulcrum below said upper side for pivoting said body about a first pivot axis parallel to the central longitudinal axis over a first range or motion; and said lower side including a second fulcrum for pivoting said body about a second pivot axis parallel and closer to said central longitudinal axis than said first pivot axis.

* * * * *